US007585373B2

(12) United States Patent
Jerg et al.

(10) Patent No.: US 7,585,373 B2
(45) **Date of Patent: *Sep. 8, 2009**

(54) DISHWASHING MACHINE

(75) Inventors: Helmut Jerg, Giengen (DE); Kai Paintner, Adelsried (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 1 day.

This patent is subject to a terminal disclaimer.

(21) Appl. No.: 11/791,377

(22) PCT Filed: Oct. 25, 2005

(86) PCT No.: PCT/EP2005/055513

§ 371 (c)(1),
(2), (4) Date: May 23, 2007

(87) PCT Pub. No.: WO2006/061293

PCT Pub. Date: Jun. 15, 2006

(65) Prior Publication Data

US 2007/0295360 A1 Dec. 27, 2007

(30) Foreign Application Priority Data

Dec. 9, 2004 (DE) ..... 10 2004 059 425
Jan. 28, 2005 (DE) ..... 10 2005 004 095

(51) Int. Cl.
*B08B 7/04* (2006.01)
*B08B 3/00* (2006.01)

(52) U.S. Cl. ..... 134/10; 134/25.2; 134/56 D; 134/57 D; 134/58 D; 134/60; 134/104.1

(58) Field of Classification Search ..... 134/10, 134/11, 18, 19, 25.2, 56 D, 58 D, 95.2, 105, 134/60, 104.1, 57 D
See application file for complete search history.

(56) References Cited

U.S. PATENT DOCUMENTS

| | | | | |
|---|---|---|---|---|
| 3,034,221 | A * | 5/1962 | Tuck et al. | 34/527 |
| 3,428,412 | A * | 2/1969 | Gilbert et al. | 8/142 |
| 2006/0278257 | A1 | 12/2006 | Jerg et al. | |
| 2007/0101609 | A1 * | 5/2007 | Jerg et al. | 34/416 |
| 2007/0157954 | A1 * | 7/2007 | Classen et al. | 134/56 D |
| 2008/0011329 | A1 * | 1/2008 | Classen et al. | 134/25.2 |

FOREIGN PATENT DOCUMENTS

DE 2 016 831 10/1971

(Continued)

OTHER PUBLICATIONS

International Search Report PCT/EP2005/055513.

*Primary Examiner*—Michael Barr
*Assistant Examiner*—Rita R Patel
(74) *Attorney, Agent, or Firm*—James E. Howard

(57) ABSTRACT

A dishwashing machine is provided with a washing compartment and with devices for washing dishes using a washing solution as well as with a sorption drying device, which is connected to the washing compartment in an air-conducting manner via an outlet of the washing compartment and via an inlet of the washing compartment and which comprises a sorption column containing reversibly dehydratable material, the outlet of the washing compartment being connected to the sorption drying device via an air duct. In order to obtain an optimized sorption drying device, the air duct is provided, at least in part, in the form of a condensing surface.

24 Claims, 2 Drawing Sheets

FOREIGN PATENT DOCUMENTS

| | | |
|---|---|---|
| DE | 103 53 775 | 2/2005 |
| EP | 0 358 279 A | 3/1990 |
| EP | 0 358 279 B | 3/1990 |
| EP | 0 777 998 | 6/1997 |
| WO | WO 2005/053502 | 6/2005 |

* cited by examiner

DISHWASHING MACHINE

BACKGROUND OF THE INVENTION

1. Field of the Invention

The invention relates to a dishwasher with a washing container and devices for washing dishes by means of rinsing liquor and with a sorption drying device which is connected in an air-conducting manner to the washing container via an outlet of the washing container and an inlet of the washing container, and is provided with a sorption column encompassing reversible dehydratable material.

2. Description of Related Art

As is known, conventional dishwashers perform a washing process whose programme sequence generally consists of at least one "Pre-wash" partial programme step, a "Clean" partial programme step, at least one "Intermediate wash" partial programme step, a "Clear wash" partial programme step and a "Dry" partial programme step. To increase the cleaning effect the rinsing fluid or rinsing liquor is heated before or during a partial programme step. The rinsing fluid is normally heated by means of electrical heating elements. Different drying systems are known for drying the items to be washed in a dishwasher.

DE 20 16 831 discloses, for example, a dishwasher of the type already mentioned in which the air is conducted from the washing container through a sealable opening in the wall of the washing container on reversibly dehydratable material, and from there to the outside through an opening. Desorption of the reversibly dehydratable material takes place during the non-operating phase of the device, the water vapour formed thereby being conducted to the outside through the opening. The dishwasher described is disadvantageous from the energy viewpoint because the regeneration of the reversibly dehydratable material takes place during a non-operating phase of the appliance, i.e. at a time when none of the partial programme steps already described is being carried out. A further disadvantage consists in the fact that the possibility of damage to the surrounding kitchen furniture cannot be ruled out as a result of the discharge of the water vapour formed during regeneration of the reversibly dehydratable material to the outside. In this case the regeneration is associated with an additional energy requirement which is additional to the energy required during the partial programme steps.

In order to minimise the energy expended during operation of a dishwasher, DE 103 53 774.0 of the applicant discloses a dishwasher with a washing container and devices for washing dishes by means of rinsing liquor which is provided with a sorption column which is connected in an air-conducting manner to the washing container and encompasses reversibly dehydratable material, where on the one hand the sorption column is used for drying the dishes and on the other hand the thermal energy utilised for desorption of the sorption column is used to heat the rinsing liquor and/or the dishes in the washing container, at least in part.

To solve the same problem DE 103 53 775.9 of the applicant proposes conducting air from a processing space and/or from ambient air through a sorption column and into the processing space for operating an appliance in the at least one "Dry" partial programme step, where the sorption column encompasses reversibly dehydratable material and moisture is extracted from the air during its through-passage.

Heating the items to be washed in the partial programme step preceding the "Dry" partial programme step is no longer normally necessary due to the use of reversibly dehydratable material with a hydroscopic property, e.g. zeolith. This allows a substantial saving in energy.

EP 0 358 279 B1 discloses a dishwasher with a closed drying system in which the air from the washing container circulates through a drying device that can be regenerated by heating and from this device back into the washing container. The drying device is assigned to the heater arranged outside the washing container for the rinsing liquor, this heater preferably being a geyser. The outlet of the washing container is located in the ceiling of the washing container, whilst the inlet is integrated in the rinsing tank of the washing container. The outlet of the washing container is connected to the sorption drying device by means of an air duct. Since the sorption drying device is assigned to the heater for the rinsing liquor it is arranged in a region underneath the rinsing tank.

A common feature of all the arrangements described above is that the integration of the sorption drying device in a dishwasher is only conceptually described. The object of this invention is therefore to provide a dishwasher in which a sorption drying device can be integrated easily and at low cost and which allows energy-efficient operation.

BRIEF SUMMARY OF THE INVENTION

An exemplary embodiment of the present invention provides a dishwasher with a sorption dryer and an air duct having a condensation surface in communication with the sorption dryer and a washing container.

A dishwasher according to the invention, particularly a domestic dishwasher, has a washing container and devices for washing dishes by means of a rinsing liquor, as well as a sorption drying device which is connected in an air-conducting manner to the washing container via an outlet of the washing container and an inlet of the washing container, and which is provided with a sorption column encompassing reversibly dehydratable material, the outlet of the washing container being connected by an air duct to the sorption drying device. According to the invention the air duct is designed at least in part as a condensation surface.

In the method according to the invention for operating a dishwasher, particularly a domestic dishwasher, with at least one "Drying" partial programme step in which is conducted from a washing container and/or ambient air through a sorption column and back into the washing container, the sorption column encompassing reversibly dehydratable material and moisture being extracted from the air as it passes through the sorption column, the air supplied to the sorption column is fed at least in part past a condensation surface in order to extract from the air taken from the washing container some of its moisture before the air having a residual moisture content is fed to the sorption column.

It is therefore possible, during the "Drying" partial programme step, to allow some of the water bound in the moist air to condensate, so that it need no longer be de-moistened by the sorption drying device. This enables a structurally simple, extremely energy-efficient dishwasher to be produced since the drying process can be completed within a shorter time.

In a suitable design of the dishwasher according to the invention the condensation surface is created by a heat-conducting connection to the washing container and/or to the ambient air. Here ambient air can be actively conducted to the air duct in a further design by means of a fan in order to obtain the condensation surface. This creates a highly spatially economic dishwasher which can be arranged in a space-saving manner, for example, between a housing wall and the washing container. Suitably no heating of the rinsing liquor and/or the items to be washed can take place in one design of the method in a partial programme step preceding the "Drying" partial programme step, e.g. "Clear washing", in order to provide as low a temperature of the washing container as possible for increasing the efficiency of the condensation surface.

In a suitable design the air duct extends along a lateral wall of the washing container. The outlet of the washing container is located in an upper section of the washing container wall to form as large a condensation surface as possible. On the other hand, the sorption drying device is preferably arranged underneath the rinsing tank for reasons of space and to create the desired condensation surface. The advantage of this is that an optimum heating element of the sorption drying device does not increase the air flow until it flows along the air duct, thus allowing condensation of the moist air in the washing container along the air duct.

A barrier against penetrating water is suitably formed in the air duct adjacent to the outlet. This barrier may represent a cover overlapping the outlet, but it may also be designed so that the section of the air duct connected to the outlet is initially guided a short distance upwards along a lateral wall and is only then guided along the lateral wall of the washing container or in wound sections downwards towards the sorption drying device. The barrier is therefore formed by a section of a wall of the air duct, which prevents moisture from penetrating the sorption drying device containing electrical functional elements during a partial programme step in which items to be washed are loaded with rinsing liquor.

In a further suitable design provision is made for the air duct to have an actuatable valve for discharging water condensed in the air duct in the bottom region. The condensed and discharged water must then no longer be absorbed by the reversibly dehydratable material, so that the sorption column of the sorption drying device can be designed smaller than a conventionally designed sorption drying device without a condensation surface. This again advantageously provides valuable space.

In a further suitable design the air duct has a pressure-regulating means which, in the case of excess pressure in the washing container, provides pressure equalisation. The pressure-regulating means may be designed as an actively operable valve. According to another design the pressure-regulating means may open or close passively according to the pressure inside the washing container, and may be designed as a valve, for example. A vacuum is formed in the air duct during the "Drying" partial programme step, in which the fan of the sorption drying device is "in operation", so that the pressure-regulating means has a sealing action. However, in the case of excess pressure, e.g. due to an expansion thrust, the pressure-regulating means can open and therefore reduce the pressure generated inside the washing container. The integration of the pressure-regulating means in the air duct of the sorption drying device enables the device ventilation that would otherwise be present in any dishwasher to be dispensed with.

Because of the sorption drying device preferably arranged in the bottom region of the dishwasher underneath a rinsing tank, it is appropriate to integrate the inlet of the washing container in the rinsing tank itself, since this enables a further air duct to be dispensed with. This allows simpler production at lower cost.

According to a further suitable design the outlet and/or inlet is/are provided with a passive means for sealing against penetrating water in the simplest case this may be cover over the outlet and/or inlet which is preferably designed so that at the same time the direction of the air flow is established to achieve the best possible turbulence of the air in the washing container for effective moisture absorption.

In an alternative design the outlet and/or the inlet may be provided with active sealing means. The sealing means may be designed, for example, so that it can be actuated by applying a voltage. The sealing means may therefore be designed so that it is motor or hydraulically driven. It is particularly advantageous here if voltage is also applied to the sealing means when voltage is applied to the fan, enabling the sealing means to open to provide air circulation to the sorption drying device. Here the inlet and outlet need only be open during the regeneration phase of the sorption column and during the "Dry" partial programme step. During the other partial programme steps the sealing means provide such sealing to prevent spray water from penetrating the sorption drying device provided with electrical functional elements.

In a further suitable design the sealing means may also be actuated by a temperature-sensitive memory metal. Here the sealing means is not actuated electrically but on the basis of the temperatures prevailing during different partial programme steps.

According to a further design the sorption column is used for drying the dishes on the one hand and the thermal energy utilised for desorption of the sorption column is used for heating the rinsing liquor in the washing container and/or the items to be washed on the other. The dishwasher can be designed, in terms of its operating principle, as described in DE 103 53 774.0 of the applicant, the contents of which are incorporated in this application where appropriate. The machine described here differs in terms of a preferred arrangement of the sorption drying device According to a preferred feature, air is conducted from the washing container and/or from the ambient air during a partial programme step with rinsing liquor to be heated, preferably during the "Clean" and/or "Pre-wash" and/or the "Clear wash" partial programme step through the sorption column and back into the washing container An electric heating element is suitably arranged for desorption of the reversibly dehydratable material and for heating the rinsing liquor and/or the items to be washed. The electrical heating element is preferably arranged in the reversibly dehydratable material or in a pipe to the sorption column.

BRIEF DESCRIPTION OF THE DRAWINGS

The invention is explained in further detail in the following with reference to the figures, in which.

DETAILED DESCRIPTION OF THE EXEMPLARY EMBODIMENTS

Figure 1:
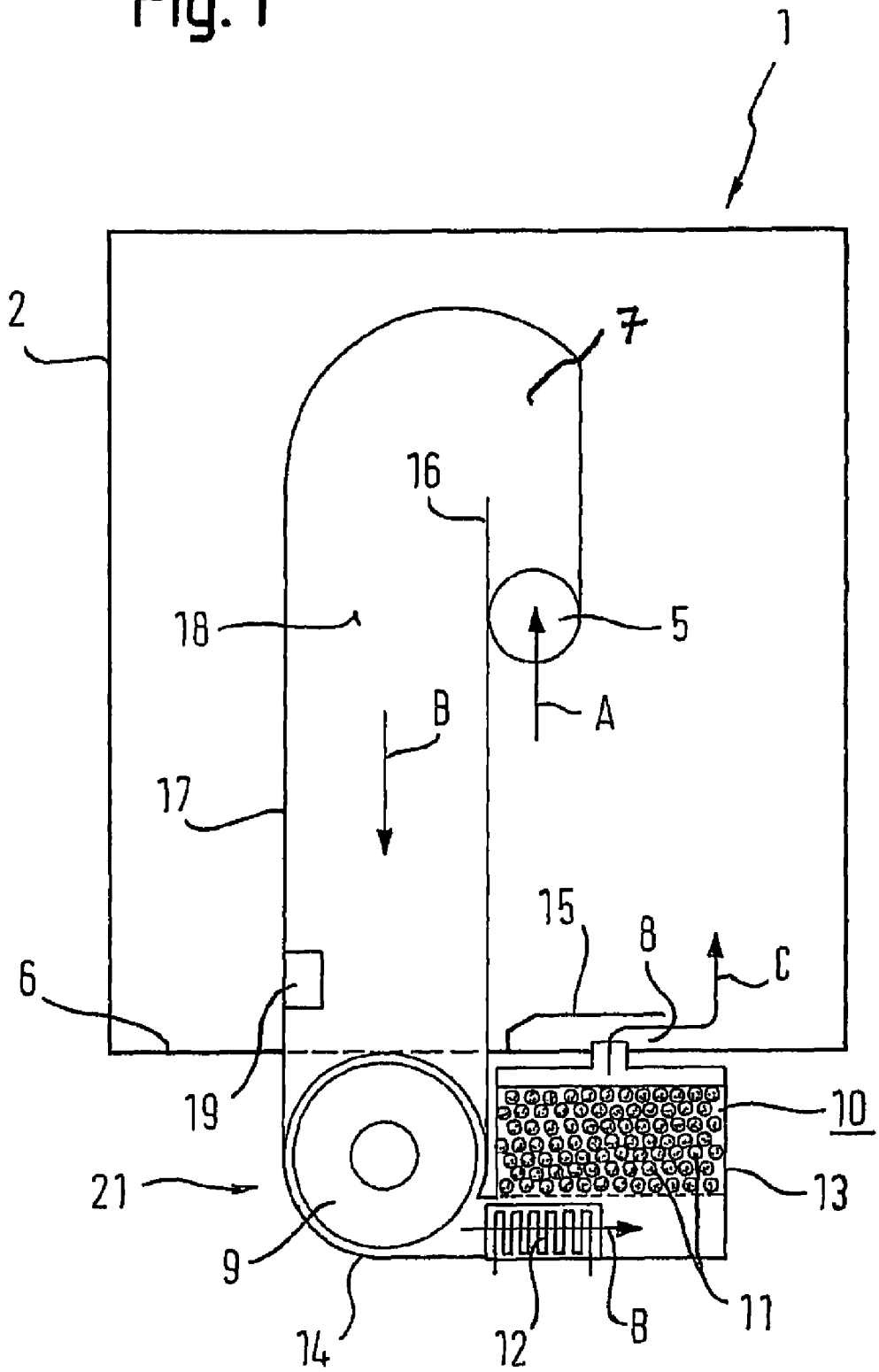
FIG. 1 shows an exemplary embodiment of a dishwasher of the invention according to a first variant.

FIG. 1 shows, in a diagrammatic representation, a dishwasher 1 of the invention according to a first variant, with a washing container 2, in which are arranged crockery baskets, not shown, for the storing of items to be washed, not shown either. The structure of the dishwasher according to the invention may in principle be as described in DE 103 53 774 and/or DE 103 53 775 of the applicant, the contents of which are also incorporated in this application if appropriate. Dishwasher 1 is provided with a sorption column 10 which is connected in an air-conducting manner to washing container 2 and encompasses reversibly dehydratable material 11, e.g. zeolith, sorption column 10 being used on the one hand for drying and on the other hand for heating air passed through. Washing container 2 has an outlet 5 which is arranged in the exemplary embodiment described in a central region and has a pipe designed as air duct 17 leading to sorption column 10, and an inlet 8 of sorption column 10 arranged in the exemplary embodiment described in a rinsing tank 6. In addition to sorption column 10, a sorption drying device 21 has a fan 9 and an electric heating element 12, a housing 14 of the fan and a housing 13 of sorption column 10 being formed integrally underneath rinsing tank 6 of the dishwasher. The passage of air through sorption drying device is denoted by arrows A, B and C.

To increase the efficiency of sorption drying device 21, particularly during the "Drying" partial programme step, air duct 17 is designed as a condensation surface 18 and is connected in an air-conducting manner to washing container 2 and/or by means of a housing wall to ambient air. To ensure maximum efficiency it is advantageous to dispense or almost dispense with heating of the washing space and/or the items to be washed in the partial programme step preceding the "Drying" partial programme step, generally "Clear wash, which is easily possible due to the drying process described. Consequently moist air flowing through air duct 17 may condensate on the walls of the air duct during the "Drying" partial programme step. The drying process in itself preferably takes place as described in DE 103 53 774 and/or DE 103 53 775. The condensate can be discharged from air duct 17 by means of valve 19, shown diagrammatically, so that this quantity of moisture need not be absorbed by sorption column 10. The advantage of this is that sorption column 10 can be dimensioned smaller, reducing the space requirement of the same. The liquid discharged from air duct 17 can either be removed from dishwasher 1 via a drain outlet of the same, not shown, or can be stored intermediately for a subsequent washing programme section.

Alternatively or additionally condensation surface 18 may be formed by ambient air, where this air can be conveyed actively, for example, by an (additional) fan to air duct 17 (not shown). Other parts of the dishwasher can also be used for drying.

To prevent the penetration of spray water during a partial programme step which items to be washed undergoes in washing container 2, in air duct 17 and hence in the electrical functional elements (fan 9, heating element 12), air duct 17 is first guided upwards from outlet 5, then along the washing container wall downwards to sorption drying device 21. Consequently a barrier 16 is formed in the air duct, which barrier reliably prevents the penetration of water.

Correspondingly, inlet 8 has a sealing means 15 which, in the exemplary embodiment, is designed as a cover with a flow function. Both outlet 5 and inlet 8 could be provided with an actively actuated sealing means according to another variant, not shown, which sealing means would be open during the operation of sorption drying device 21 and closed in the remaining partial programme steps. Particularly advantageous here is a direct coupling to the operation of fan 9 and/or electric heating element 12. Thus the active sealing means could be actuated by means of a motor or hydraulically, the actuation being dependent on the operation of the sorption drying device. Alternatively the use of a memory metal would also be conceivable, which metal could be brought into an opening or closing position according to the varying temperatures during different partial programme steps.

Figure 2:
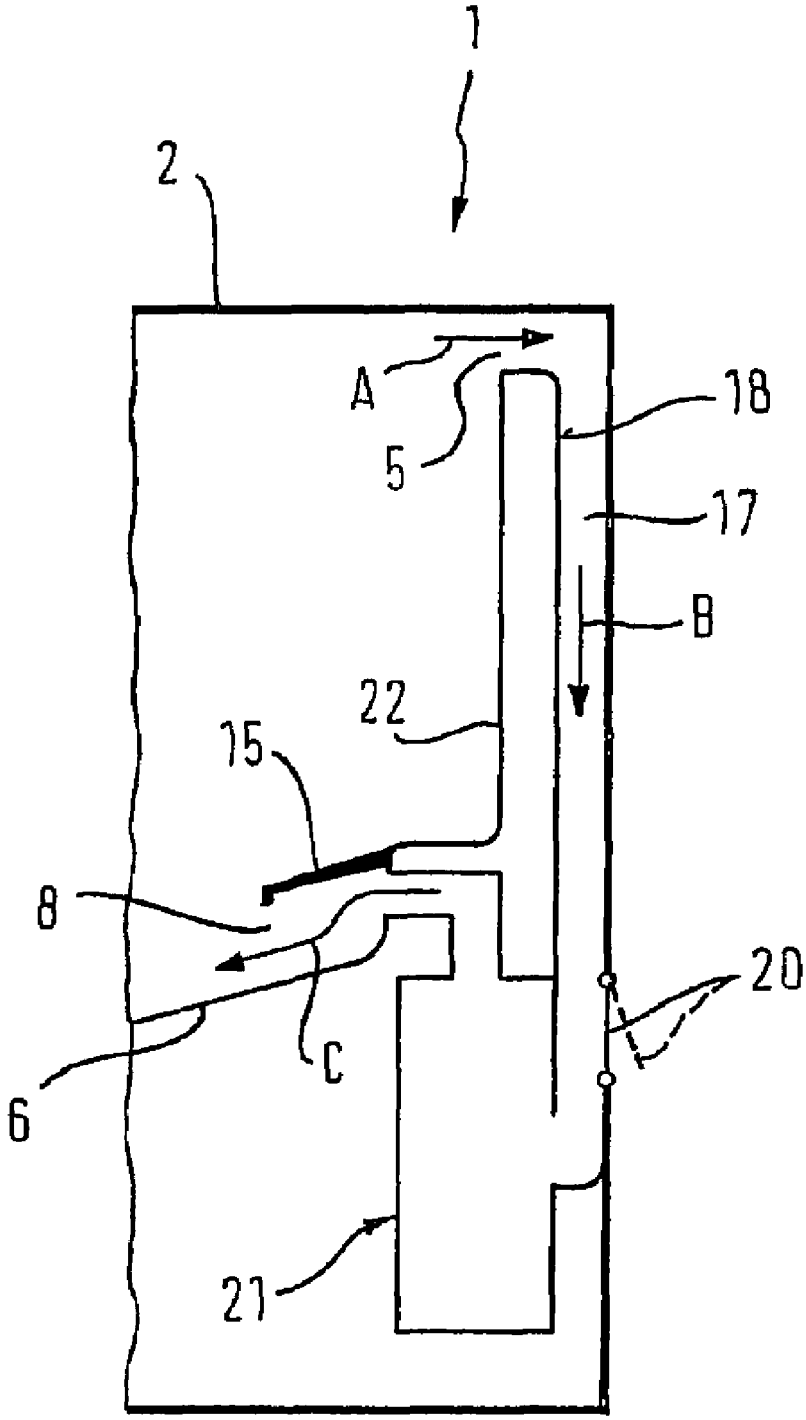
FIG. 2 shows a further exemplary embodiment of a dishwasher of the invention in which the device ventilation is integrated in the sorption drying device.

FIG. 2 shows a section of a further exemplary embodiment of a dishwasher 1 according to the invention, in which a valve 20 is integrated in air duct 17, which performs the function of device ventilation in the case of an expansion thrust. In the simplest case valve 20 can be designed as a mechanical valve which is retained in the closing position for example, due to the fan (not shown) in sorption drying device 21 and due to the vacuum generated thereby in a closing position as long as sorption drying device 21 is in operation (continuous line). In the case of an expansion thrust the excess pressure generated inside the washing container is distributed along air duct 17 as far as valve 20, the latter opening (dotted line). This ensures that no damage can be caused to the dishwasher due to an excess pressure that is suddenly generated.

Moreover, the design shown in FIG. 2 corresponds to a dishwasher of the invention according to the first variant, where air duct 17 is connected in an air-conducting manner to washing container 2 and/or a housing wall to form a condensation surface 18. Sorption drying device 21, shown only diagrammatically, is arranged laterally underneath rinsing tank 6, for example, inlet 8 being formed in the border region between rinsing tank 6 and washing container wall 22. To prevent the penetration of water in sorption drying device 21, a (passive) sealing means 15 in the form of a flow-influencing plate is provided, for example, above outlet 8.

With this invention a dishwasher is provided which can be produced economically and with which the items to be washed in the washing container can be cleaned and dried efficiently, with the possibility of minimising the associated energy expenditure.

LIST OF REFERENCE SYMBOLS

1 Dishwasher
2 Washing container
5 Outlet
6 Rinsing tank
8 Inlet
9 Fan
10 Sorption column
11 Reversibly dehydratable material
12 Electrical heating element
13 Fan
14 Fan
15 Sealing means
16 Barrier
17 Air duct
18 Condensation surface
19 Valve
20 Valve
21 Sorption drying device
22 Washing container wall
23 Housing wall
A,B,C Air passage

The invention claimed is:

1. A dishwashing machine comprising:

a washing container;

at least one device for washing crockery using a washing solution;

a heating device; and a sorption drying device communicated with the washing container for a passage of air between the sorption drying device and the washing container, the sorption drying device containing a reversibly dehydratable material that operates to withdraw moisture from air during a passage of air through the sorption drying device, air exiting from the washing container via a washing container outlet into an air duct of the sorption drying device communicated therewith and thereafter flowing along a flow path through the sorption drying device and eventually exiting the sorption drying device to return to the washing container via a washing container inlet, and the air duct of the sorption drying device being configured at least in part as a condensation surface, wherein the condensation surface is formed by a heat-conducting connection to one of a heat-conducting connection to the washing container and a heat-conducting connection to ambient air.

2. The dishwashing machine according to claim 1, wherein the ambient air can be conducted actively by a fan to the air duct of the sorption drying device in order to obtain the condensation surface.

3. The dishwashing machine according to claim 1, wherein the air duct of the sorption drying device extends along a lateral wall of the washing container.

4. The dishwashing machine according to claim 1, wherein the sorption drying device is arranged in a bottom region of the dishwashing machine underneath a rinsing tank.

5. The dishwashing machine according to claim 1, wherein a barrier against penetrating water is formed in the air duct of the sorption drying device adjacent to the washing container outlet.

6. The dishwashing machine according to claim 1, wherein the air duct of the sorption drying device is arranged in a bottom region of the dishwashing machine and the bottom region has an actuatable valve for discharging water condensed in the air duct of the sorption drying device.

7. The dishwashing machine according to claim 1, wherein the air duct of the sorption drying device has a pressure-regulating means which, in a case of an excess pressure generated in the washing container, provides a pressure equalisation.

8. The dishwashing machine according to claim 7, wherein the pressure-regulating means is an actively actuatable valve.

9. The dishwashing machine according to claim 7, wherein the pressure-regulating means passively opens or closes due to the pressure present inside the washing container.

10. The dishwashing machine according to claim 1, wherein at least one of the washing container outlet and the washing container inlet is provided with a passive sealing means against penetrating water.

11. The dishwashing machine according to claim 1, wherein at least one of the washing container outlet and the washing container inlet is provided with an active sealing means.

12. The dishwashing machine according to claim 11, wherein the sealing means is actuated by an application of a voltage.

13. The dishwashing machine according to claim 12, wherein the voltage is applied to the sealing means in connection with the application of a voltage to a fan.

14. The dishwashing machine according to claim 11, wherein the sealing means is actuated by a temperature-sensitive memory metal.

15. The dishwashing machine according to claim 1, wherein, the sorption drying device is used to dry crockery being handled by the dishwashing machine and, thermal energy utilized for desorption of the sorption drying device is used to at least partially heat at least one of the washing solution in the washing container and crockery.

16. The dishwashing machine according to claim 15, wherein at least one of air conducted from the washing container and ambient air is conducted during a partial programme with a washing solution applied to wash item to be heated, during one of a Clean, Pre-wash, and Clear wash partial program, through the sorption drying device and back into the washing container.

17. The dishwashing machine according to claim 15, wherein an electric heating element is arranged for desorption of the reversibly dehydratable material and for heating a washing solution applied to a wash item.

18. The dishwashing machine according to claim 17, wherein the heating element is arranged in the reversibly dehydratable material or in a pipe to the sorption column.

19. The dishwashing machine of claim 1, wherein the heat-conducting connection comprises a condensation surface cooler that removes heat from the condensation surface.

20. A method for treating crockery disposed in a washing container, comprising:

subjecting crockery to a washing, a rinsing, and a drying, wherein air is passed into contact with the crockery during at least one of the washing, rinsing, and drying and such air is thereafter guided to a sorption drying device communicated with the washing container for the passage of air between the sorption drying device and the washing container, the sorption drying device containing reversibly dehydratable material that operates to withdraw moisture from air during the passage of the air through the sorption drying device, crockery retained in the dishwasher being subjected to a drying after having undergone a treatment as a result of which moisture remains on the crockery with the drying including passing air from the washing container through the sorption drying device;

flowing air from the washing container at least in part past a condensation surface in order to extract therefrom some of its moisture before the air, which still has a residual moisture content, is fed thereafter to the sorption drying device; and cooling the condensation surface with a condensation surface cooler.

21. The method according to claim 20, and further comprising no heating of a washing solution applied to wash items nor of the items to be washed takes place in a partial programme preceding the drying.

22. A dishwasher comprising:

a washing container;

a crockery washer in the washing container;

a heater that heats a washing fluid for the crockery washer;

a sorption dryer containing a reversibly dehydratable material and a condensation surface in communication with the washing container; and a condensation surface cooler that removes heat from the condensation surface.

23. The dishwasher of claim 22, wherein the condensation surface cooler comprises an ambient air conductor that conducts ambient air to the condensation surface.

24. The dishwasher of claim 22, wherein the condensation surface cooler further comprises a fan.

* * * * *